United States Patent [19]

Fields

[11] 4,293,795

[45] Oct. 6, 1981

[54] SOLID STATE FLASHER RELAY

[75] Inventor: Carlo Fields, Woodland, Calif.

[73] Assignee: Southern Pacific Transportation Company, San Francisco, Calif.

[21] Appl. No.: 111,320

[22] Filed: Jan. 11, 1980

[51] Int. Cl.[3] ..... H05B 39/06

[52] U.S. Cl. ..... 315/200 A; 307/41; 315/193; 315/207; 315/322; 340/83

[58] Field of Search ..... 315/186, 193, 200 A, 315/201, 207, 209 R, 210, 211, 217, 322, 121–123, 125; 307/36, 37, 41; 340/47, 83, 331; 246/125, 293

[56] References Cited

U.S. PATENT DOCUMENTS

| | | | |
|---|---|---|---|
| 3,631,392 | 12/1971 | Zelina | 340/331 X |
| 3,925,704 | 12/1975 | Camic | 315/200 A |
| 3,963,202 | 6/1976 | Hopkins | 246/125 |

OTHER PUBLICATIONS

WC Solid State (EOR) Flashing Relay, Western-Cullen Division of Federal Sign & Signal Corp., Chicago, Ill., Aug. 1976.

Solid State Grade Crossing Flasher Model 210A, Harmon Electronics Division of Harmon Industries, Inc., May 1975.

*Primary Examiner*—Eugene R. La Roche

*Attorney, Agent, or Firm*—Freilich, Hornbaker, Wasserman, Rosen & Fernandez

[57] ABSTRACT

A solid state flasher relay of the type for switching an AC or a DC voltage across first and second loads interconnected at a common junction. More specifically, a solid state flasher relay is disclosed wherein shunting transistors are selectively controlled so that an AC or a DC voltage applied across two input lines connected to the first and second loads can be either shunted from the first input line to the common junction thereby providing the voltage across the second load, or shunted from the second input line to the common junction thereby applying the voltage across a first load. Shunting is effected by biasing four shunting transistors so that two of the shunting transistors connected between one input line and the common junction line will not conduct, while one of the other two shunting transistors connected across the other input line and the common junction line will conduct, the specific shunting transistor chosen to conduct being determined by the polarity of the voltage applied across the two input lines. This is effected by choosing each of the shunting transistors as either an npn or pnp type and controlling them so that one selectively conducts in accordance with the instanteous input voltage polarity. In addition, the flasher relay disclosed provides a means for effecting this control while at the same time isolating the two input lines and common junction lines from any grounds associated with the flasher relay.

21 Claims, 4 Drawing Figures

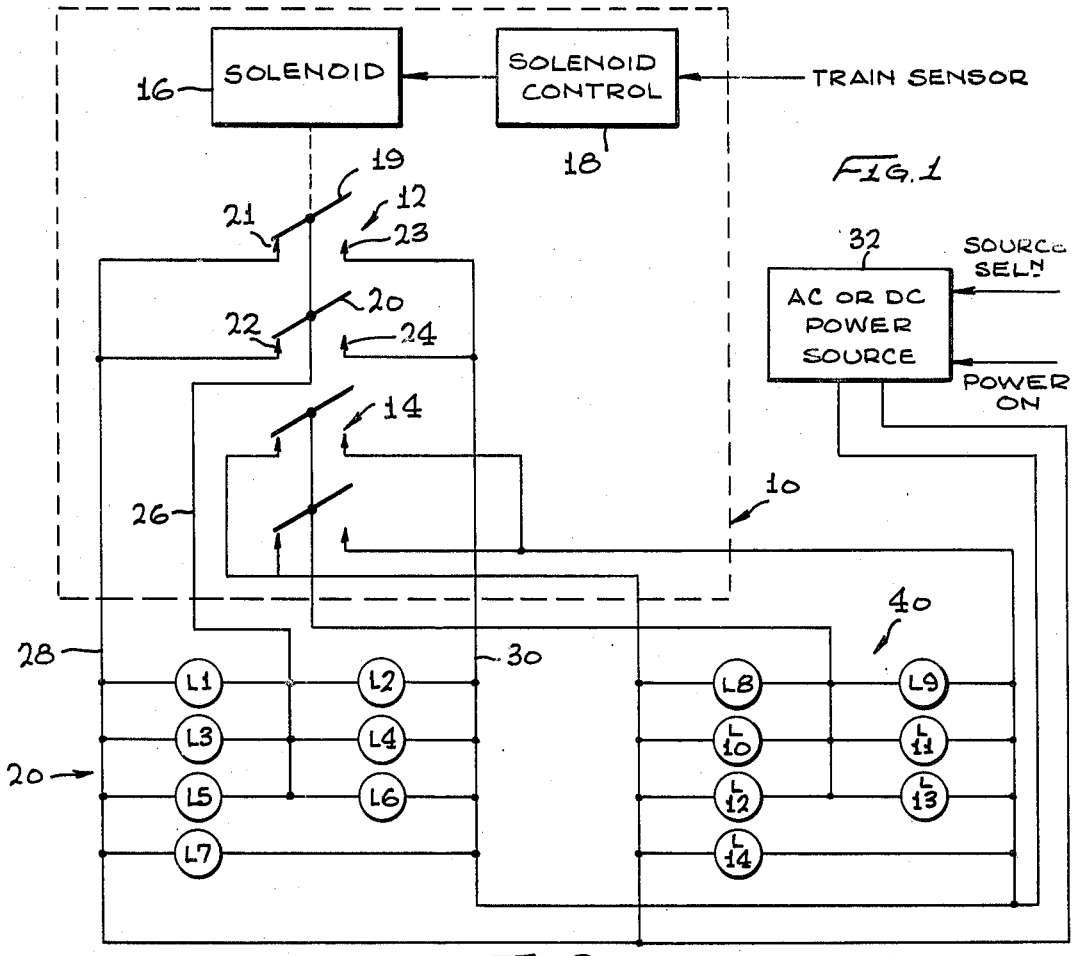
FIG. 1
FIG. 4
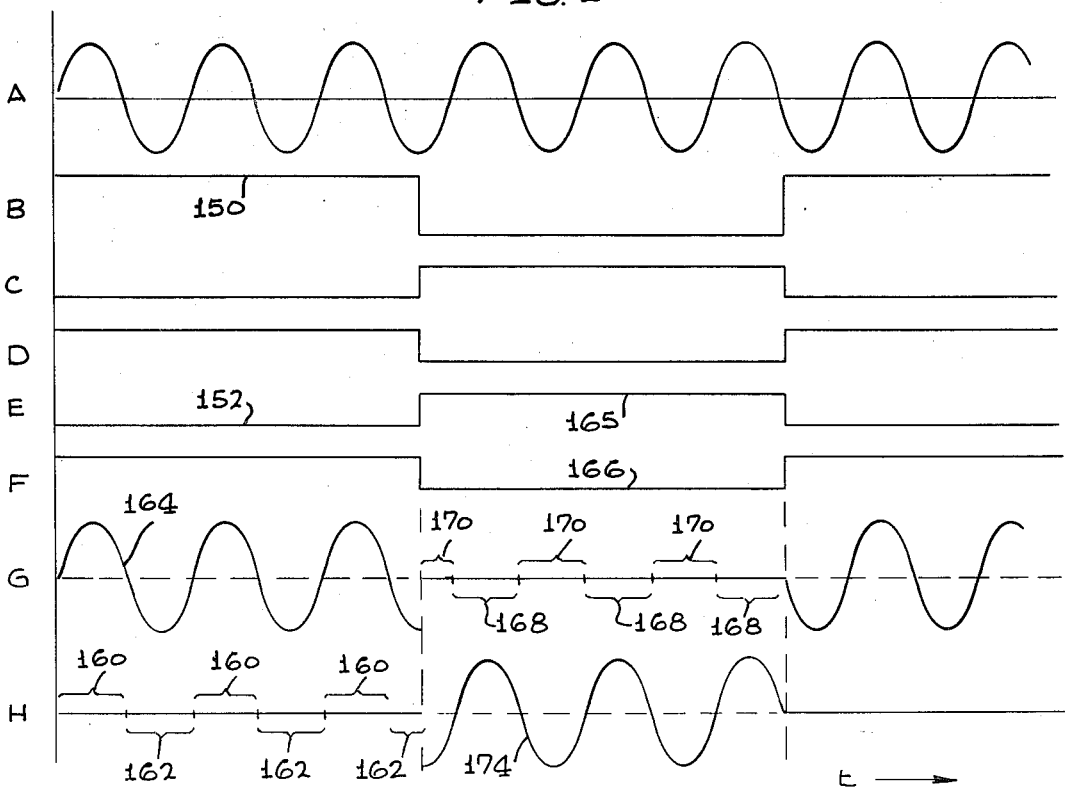

AC OR DC POWER
A
20
28
Z1
26
Z2
30
86
G
H
76
66
136
70
80
126
E
128
132
134
130
F
142
146
74
64
122
78
114
68
112
118
120
116
108
100
96
98
98'
140
144
73
40
74
104
106
88
94
92
C
D
102
B
90
SQUARE WAVE OSC.
101
+
−
TRAIN SENSOR

SOLID STATE FLASHER RELAY

BACKGROUND OF THE INVENTION

The invention relates to a flasher relay and more specifically to flasher relays adapted to be utilized for controlling flashing lights on automatic highway crossing gates typically used in railroad grade crossing signal installations.

Relays for controlling flashing lights mounted on arms lowered at railroad grade crossings when a train is approaching have typically been of the mechanical type. The flashing lights are usually configured so that one group of lights are connected to one side of a power source, and another group of lights are connected to the other side of a power source. Each group of lights is interconnected at a common junction so that three leads are provided, a first input line, a common junction line, and a second input line. The mechanical relays conventionally utilized sequentially short the first input line to the common junction line and then the second input line to the common junction line, thereby resulting in the power source being applied first across the first group of lights and then across the second group of lights. As one can appreciate, use of a mechanical relay allows the power source to be either AC or DC because current can flow in either direction across the relay contacts. An AC power source is typically utilized as the primary power source, a back up power source being provided if the AC power source either fails or is no longer available. Typically this back up power source is a DC power source. The mechanical relay is usually controlled by an input signal responsive to a sensor located on the railroad tracks, the sensor providing an indication that a train is approaching the grade crossing. Internal to the relay is a timer which controls switching between the first group of lights and the second group of lights. As can be appreciated, mechanical relays of the above type frequently have reliability problems due to degradation in the relay contacts. In addition, mechanical relays are generally more expensive than relays using solid state switching devices. Thus the higher cost and lower reliability of mechanical relays make it highly desirable to have a solid state relay which would be directly interchangeable with the typical mechanical flasher relay, thereby providing a replacement relay which would not require any installation modifications.

Solid state flasher relays have been developed. However, these relays require separate input power lines. If the input power is AC, the conventional solid state relay provides a means for converting the AC power to DC power, and then switching the DC power between the two groups of lights. This conversion is required in order to utilize solid state switching devices which accomodate current flow in only one direction. A major problem with this type of relay is that wiring changes external to the relay must be effected in order to apply the power from the power source directly to the relay for conversion, and to disconnect the power source from the lights. This requires additional cost and time and discourages replacement of mechanical relays with a cheaper and more reliable solid state relay. The present invention solves the above problems by providing a solid state flasher relay which is directly interchangeable with a mechanical flasher relay and can provide direct switching of AC or DC voltages across two groups of lights.

SUMMARY OF THE INVENTION

The invention provides a flasher relay of the type wherein an AC or DC input voltage provided across first and second loads interconnected in series to a common junction line can be selectively applied across the first load or the second load. The invention includes a first solid state shunting means for shunting the first load so that the input voltage is applied across the second load, and a second solid state shunting means for shunting the second load so that the input voltage is applied across the first load.

In a specific embodiment, the first and second solid state shunting means each includes a pair of shunting transistors connected in parallel across one of the loads so that one can conduct when a positive voltage differential is applied across its emitter and collector terminals, and the other can conduct when a negative voltage differential is applied across its emitter and collector terminals. A means is provided for selectively controlling the base terminals of each shunting transistor so that one pair of shunting transistors is biased off whenever one of the shunting transistors in the other pair is conducting. By this selective control of the biasing of the base terminals of the four shunting transistors, the first input line can be continually shorted to the common junction line regardless of the polarity of the input voltage, and then the second input line can be continually shorted to the common junction line. Thus, the flasher relay provided by the invention is directly interchangeable with conventional mechanical relays utilized in grade crossing flashing systems, while at the same time incorporating the reliability and cost reduction realizable by using a solid state switching means. In addition, the flasher relay provided by the invention incorporates circuitry which isolates the input power being switched between the first and second loads from any grounds associated with the relay itself, thereby allowing the ground of the power source to float with respect to that of the flasher relay. This isolation is effected by incorporating an optical coupling means for effecting control of the base terminals of the four shunting transistors.

BRIEF DESCRIPTION OF THE DRAWINGS

FIG. 1 is a functional schematic diagram of a conventional grade crossing flasher relay utilizing mechanical contacts;

FIG. 4 are waveform diagrams showing voltages at various points in the schematic of FIG. 3.

DETAILED DESCRIPTION

Figure 2:
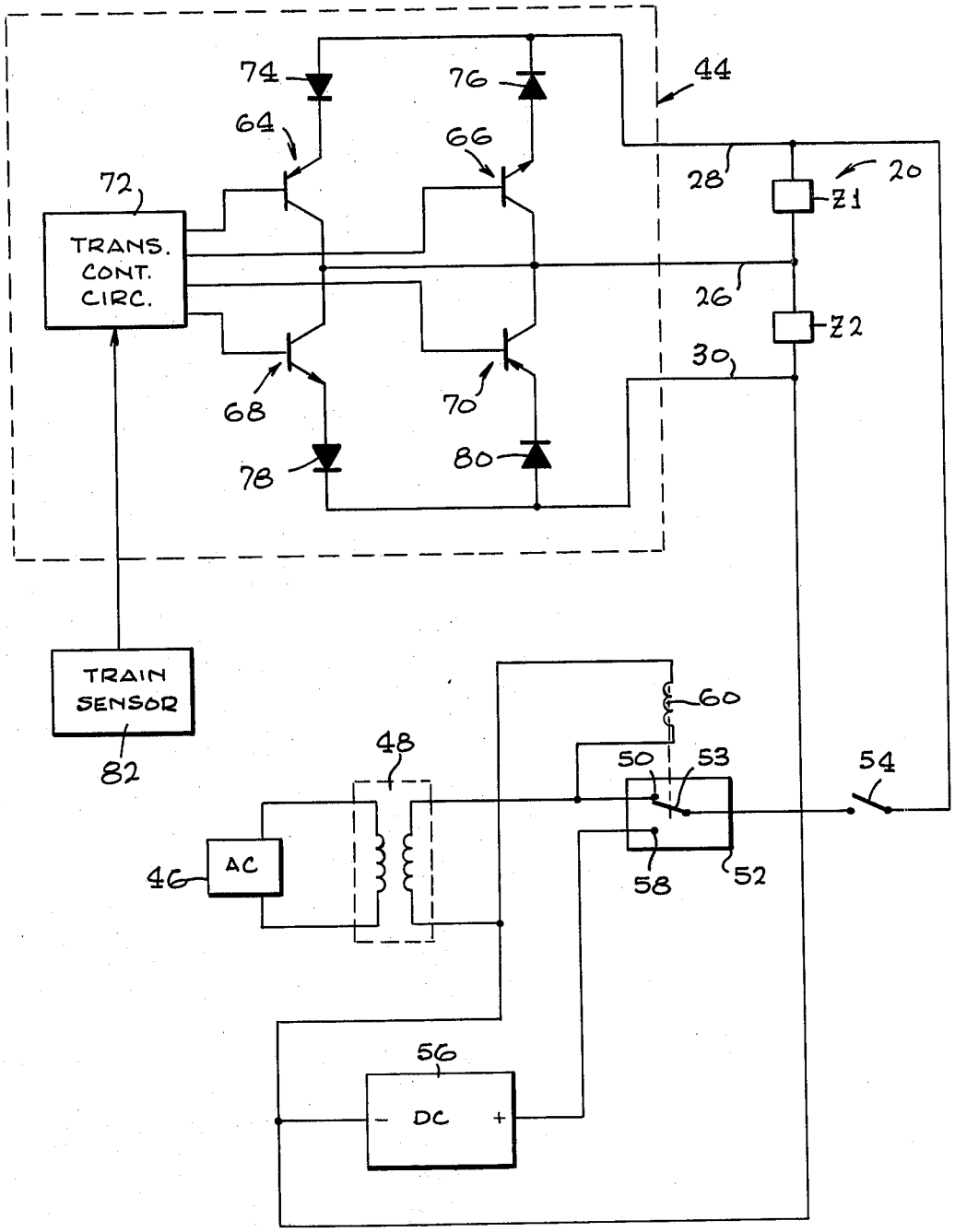
FIG. 2 is a schematic and block diagram of a flasher relay provided by invention.

A detailed illustrative embodiment of the invention disclosed herein exemplifies the invention and is considered to be the best embodiment for such purposes. It is provided by way of illustration and not limitation of the invention. Various modifications thereof will occur to those skilled in the art, and such modifications are within the scope of the claims which define the present invention.

As previously explained, a flasher relay is disclosed which is interchangeable with conventional railroad crossing flasher relays and provides a solid state means for selectively switching an AC or DC input voltage across first and second loads, the input voltage being applied to the loads at points external to the relay itself. The switching means comprises first, second, third and fourth shunting transistors, the first and second shunting transistors being connected in parallel with respect to the first load, and the third and fourth shunting transistors being connected in parallel with respect to the second load. The loads and each of the shunting transistors are interconnected at a common junction line, the first load being connected to the flasher relay via a first input line and the second load being connected to the flasher relay via a second input line. The AC or DC voltage is applied to the first and second input lines. The flasher relay incorporates a control means for causing either the first or second shunting transistor to shunt the first input line to the common junction line, the first shunting transistor conducting when the input voltage as measured from the first input line to the second input line is of one polarity, and the second transistor conducting when the input voltage is of the other polarity. The control means also biases the third and fourth shunting transistors so that neither will conduct while either of the first or second shunting transistors is conducting. Thus by shunting the first input line to the common junction line, the total input voltage is applied across the second load which is connected to the common junction line and the second input line. Similarly, the control means causes the third and fourth transistors to shunt the second input line to the common line when the input voltage is desired to be applied to the first load. It should be noted that the solid state relay disclosed directly switches both AC and DC input voltages, and does not require any conversion of an AC input voltage to a DC voltage prior to application of that voltage to the first and second loads.

Referring now to FIG. 1, a conventional railroad flasher relay 10 includes a first relay bank 12 and a second relay bank 14, the first and second relay banks 12 and 14 being controlled by a solenoid 16. The solenoid is activated by a solenoid control unit 18 responsive to a train sensor (not shown) for indicating when a train is approaching a grade crossing. The relay banks 12 and 14 are typically of a gravity type wherein contacts 19 and 20 contact terminals 21 and 22 when the solenoid is activated, and then contact terminals 23 and 24 (not shown) due to gravitational force when the solenoid is not activated. Two pivotal contacts and associated terminals are provided for redundancy and reliability purposes. The railroad crossing flasher relay 10 is configured to control two banks of lights on highway crossing gates which are lowered when a train is about to cross a surface street. Each gate has a plurality of lights, the first gate having lights designated as L1–L7, and the second gate having lights designated as L8–L14. The first bank of lights 20, which consists of lights L1–L7, are configured so that the first three pair of lights consisting of L1 and L2, L3 and L4, and L5 and L6, are interconnected at a common junction line 26. Three of the lights L1, L3, and L5, which comprise a first load, are connected to a first input line 28 and three other lights L2, L4 and L6, which comprise a second load, are connected to a second input line 30. An AC or DC power source 32 is provided, its output lines being connected to the first and second input lines 28 and 30. The first input line 28 is connected to contact terminals 21 and 22 of the first relay bank 12, and the second input line 30 is connected to contact terminals 23 and 24 of the first relay bank. The common junction line 26 is connected to the two pivotal contacts 19 and 20. A seventh light L7 is connected across the first and second input lines 28 and 30 and is continuously on whenever power is applied to the first and second input lines 28 and 30.

In operation, the flasher relay 10 is designed to alternately cause lights L1, L3 and L5 to light, and then lights L2, L4 and L6 to light. Thus, when the first pivotal contact 19 of the first relay bank 12 contacts terminal 21, the first input line 28 is shorted through the first pivotal contact 19 to the common junction line 26, thereby shunting the three lights L1, L3 and L5. This causes the entire output voltage from the AC or DC power source 32 to be applied across lights L2, L4 and L6. However, when the solenoid 16 is deactivated, the first pivotal contact 19 then contacts terminal 23. This shorts the second input line 30 to the common junction line 26, thereby applying the full input voltage across lights L1, L3 and L5. Thus, as the solenoid 16 causes the pivotal contacts 19 and 20 to pivot back and forth, the three lights L2, L4 and L6 flash on and off as the three lights L1, L3 and L5 flash off and on. The seventh light L7, as previously explained, always remains on so long as power is applied.

Due to redundancy and safety features incorporated in all railroad grade crossing equipments, a means is provided so that should an AC power failure occur, DC power will be applied across the first and second input lines 28 and 30. The conventional railroad crossing relay 10 utilizes mechanical contacts which can shunt both AC and DC currents equally well. The relay disclosed provides a means for functionally duplicating a conventional mechanical contact relay with a solid state relay which can directly switch both AC and DC currents when an AC or DC voltage is externally applied across first and second serially-connected loads. A typical railroad flasher relay also controls a second bank of lights 40 through the second relay bank 14 operated by the same solenoid 16. Control of the second bank of lights 40 is identical to that previously explained for the first bank of lights 20. Thus as can be seen, the conventional railroad crossing flasher relay 10 has input lines corresponding to the first input line 28, the second input line 30 and the common junction line 26 for each of two banks of lights 20 and 40. In addition it has a control signal input for indicating that a train is approaching a grade crossing.

The basic elements of a solid state flasher 44 in accordance with the present invention can be seen in FIG. 2. Although the solid state flasher relay 44 is shown as driving only two sets of loads Z1 and Z2, a typical configuration as previously explained provides redundant portions to drive a second set of loads as shown in FIG. 1. Referring now to FIG. 2, an AC power source 46 is connected to a step-down transformer 48. One output of the step-down transformer 48 is provided to a first contact 50 of a power selection switch 52. A wiper arm 53 of the power selection switch 52 is connected to a power-on switch 54 which is connected in series to the first input line 28. The power-on switch 54 is located so that it is closed whenever a train approaches a graded crossing. One output of a DC power source 56 is connected to a second contact 58 of the power selection switch 52. A holding solenoid 60 is provided which causes the wiper arm 53 of the power selection switch 52 to contact the first contact 50 whenever AC power is present at the output of the step-down transformer 48. Thus, AC power will be provided across the first and second input lines 28 and 30 so long as AC power is present. However, if AC power is not present, the holding solenoid 60 is deactivated, thereby allowing the wiper arm to contact the second contact 58 either by spring action or gravity depending on the particular type of power selection switch 52 chosen. Thus in the absence of AC power, it can be readily appreciated that DC power is then applied through the power-on switch 54 and across the first and second input lines 28 and 30. Such a power system is essential in highway crossing gate lighting systems in order to insure that a power source will always be available to power the lights whenever a train is approaching. Thus, as has been previously explained, the solid state flasher relay 44 must be chosen to alternately shunt the first input line 28 to the common junction line 26 and then the second input line 30 to the common junction 26 regardless of the type of power applied to the first and second input lines.

Referring now to the solid state flasher relay 44 shown in FIG. 2, a first shunting transistor 64 and a second shunting transistor 66 are connected between the first input line 28 and the common junction line 26. Similarly, a third shunting transistor 68 and a fourth shunting transistor 70 are connected between the second input line 30 and the common junction line 26. A transistor control circuit 72, which will be explained in detail below, alternately biases the first and second shunting transistors 64 and 66 so that one of them will conduct when the first load Z1 is to be bipassed, and the third and fourth shunting transistors 68 and 70 so that one of them will conduct when the second load Z2 is to be bipassed. During periods when the first and second shunting transistors 64 and 66 are biased so that one can conduct, the third and fourth shunting transistors 68 and 70 are biased off so that they can not conduct. In a similar manner, when the third and fourth shunting transistors 68 and 70 are biased so that one of them can conduct, the first and second shunting transistors 64 and 66 are biased off so that they can not conduct. Thus, during AC voltage application when the voltage on the first input line 28 is positive with respect to that on the second input line 30, and the first shunting transistor 64 is biased to conduct, current flows through a first blocking diode 74, the emitter terminal of the first shunting transistor 64 which is chosen to be a pnp type transistor, and the collector terminal of the first shunting transistor 64 to the common junction line 26. Thus during this positive portion of the AC voltage cycle, the first input line 28 is shorted to the common junction line 26, thereby resulting in the entire AC voltage being applied across the second load Z2. Similarily, when the voltage on the first input line 28 is negative with respect to the voltage on the second input line 30, current flows through a second blocking diode 76, the emitter terminal of the second shunting transistor 66 which is chosen to be an npn type, and the collector terminal of the second shunting transistor 66. Thus when the voltage on the first input line 28 is negative with respect to that on the second input line 30, the common junction line 26 is also shorted to the first input line 28, again applying the full voltage potential across the second load Z2. Thus when the transistor control circuit 72 is activated to bias the first and second shunting transistors 64 and 66 to conduct, then regardless of the instantaneous polarity of the AC voltage impressed across the first and second input lines 28 and 30, one of the shunting transistors 64 and 66 will be conducting, thereby shorting the first input line 28 to the common junction line 26. In a similar manner, when the first and second shunting transistors 64 and 66 are biased off and the third and fourth shunting transistors 68 and 70 are biased on, current will flow through the third shunting transistor 68 and an associated third blocking diode 78 when the voltage on the second input line 30 is negative with respect to that on the first input line 28, and will flow through the fourth shunting transistor 70 and an associated blocking diode 80 when the voltage on the second input line 30 is positive with respect to that on the first input line 28. The transistor control circuit 72 incorporates a square wave oscillator to be described below which alternately biases the first and second shunting transistors 64 and 66 on and then off, and the third and fourth shunting transistors 68 and 70 off and then on so that either the first and second shunting transistors 64 and 66 or the third and fourth shunting transistors 68 and 70 are always biased on. A train sensor 82 activates the square wave oscillator in the transistor control circuit 72 so that the input voltage is switched between the first and second loads Z1 and Z2 at a rate between 35 and 55 times per minute.

Figure 3:
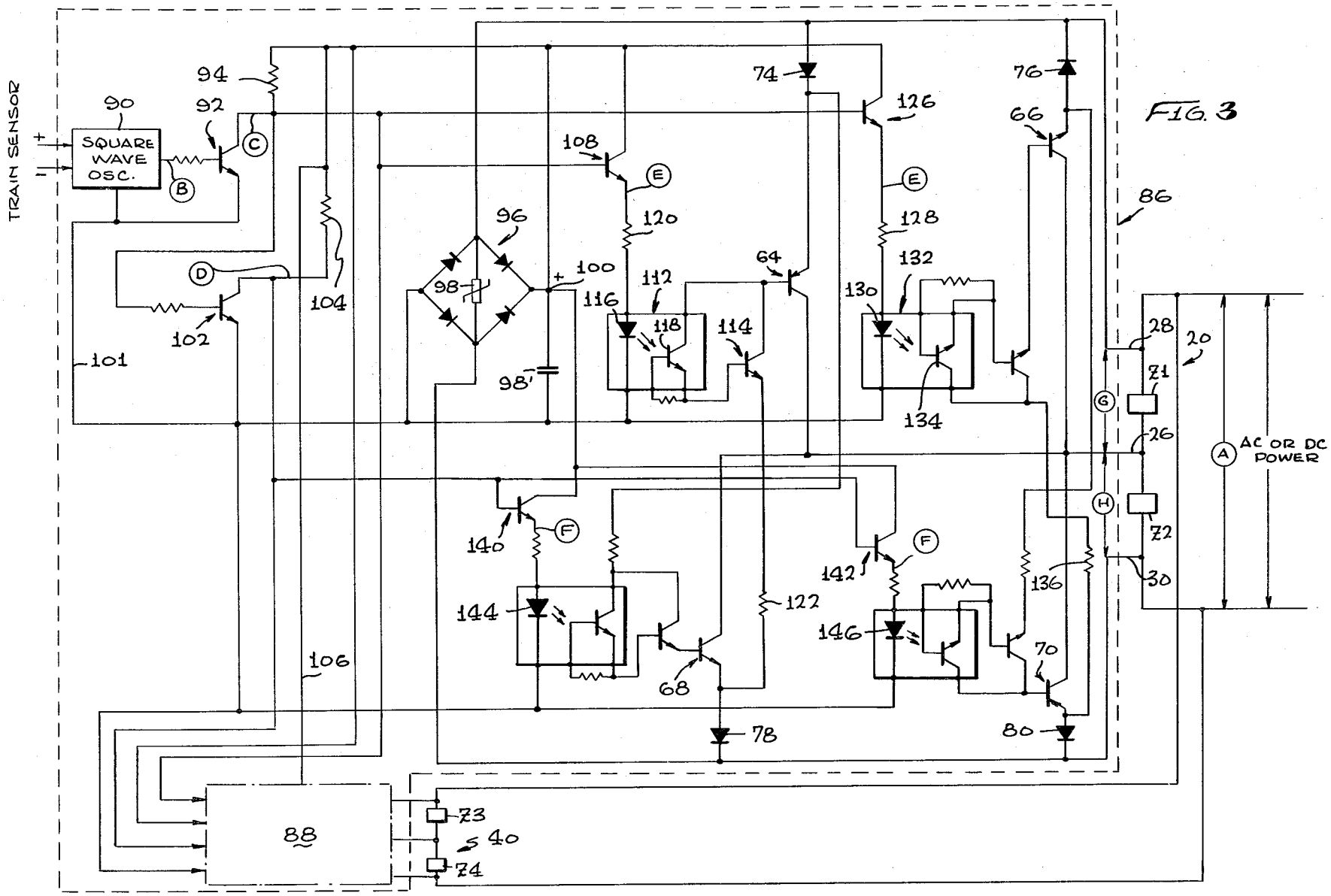
FIG. 3 is a schematic diagram of the flasher relay shown in FIG. 2.

Referring now to FIG. 3, a solid state flasher relay 86 functionally duplicating the mechanical flasher relay 10 shown in FIG. 1 is shown. Because first and second banks of lights 20 and 40, respectively, are to be controlled, redundant circuitry is required. FIG. 3 shows switching circuitry for the first bank of lights 20, identical switching circuitry required for the second bank of lights 40 being contained within the dotted lines shown at 88. A control signal input from the train sensor is provided to a conventional solid state square wave oscillator 90 which provides a square wave output signal to the base terminal of a first switching transistor 92. The collector terminal of the first switching transistor 92 is connected through a dropping resistor 94 to a DC voltage source provided by a conventional full wave rectifier 96, the rectifier having a standard surge protector 98 connected across its two input terminals. A smoothing capacitor 98' is provided for smoothing the rectified signal from the full wave rectifier 96, thereby providing a substantially constant DC voltage between a positive output terminal 100 and a return line 101. Thus, the voltage present at the collector terminal of the first switching transistor 92 is positive when the switching transistor 92 is biased off and not conducting, and is zero when the first switching transistor 92 is biased on and conducting because the collector terminal, through the emitter terminal, is connected to the return line 101. The collector terminal of the first switching transistor is also connected to the base terminal of a second switching transistor 102. The collector terminal of the second switching transistor is also connected to the positive output terminal 100 of the full wave rectifier 96 through a second dropping resistor 104. Thus, when the first switching transistor 92 is biased off, the positive voltage appearing at its collector terminal, and thus at the base of the second switching transistor 102, results in the second switching transistor 102 being biased on, thereby shorting its collector terminal, through its emitter terminal, to the return line 101. When the first switching transistor 92 is biased on, its collector terminal is shorted to the return line 101. This results in the second switching transistor 102 being biased off, thereby raising its collector terminal voltage level to the output voltage of the full wave rectifier at terminal 100. Thus, the two switching transistor collector terminals provide square wave output signals displaced 180 degrees in phase with respect to each other, their periods being determined by the period of the output signal from the square wave oscillator 90. The two square wave output signals from the first and second switching transistors 92 and 102 are utilized in a manner to be explained to control the shunting transistors 64, 66, 68 and 70. A second full wave rectifier (not shown) identical to the first full wave rectifier 96 is included in the switching circuitry within the dotted lines shown at 88, its output being provided by a connection line 106 to the output terminal 100 of the first full wave rectifier 96.

Control circuitry for the first shunting transistor 64 includes a first control transistor 108, a first optical coupler 112, and a second control transistor 114. The optical coupler 112 includes a light emitting diode 116 and a light-responsive transistor 118. In operation, the circuit is activated by a positive voltage appearing at the collector terminal of the first switching transistor 92, this positive voltage being applied to the base terminal of the first control transistor 108 and causing it to conduct. This causes the voltage at the full wave rectifier 96 output terminal 100 to be applied to a dropping resistor 120, thereby causing a current flow through the light emitting diode 116. The light radiated by the diode 116 biases its associated light-responsive transistor 118 on, thereby biasing the second control transistor 114 on by shorting its collector terminal to its base terminal. If the voltage from the first input line 28 with respect to the voltage on the second input line 30 is positive, then the emitter terminal of the second control transistor 114 through another dropping resistor 122 and the third blocking diode 78, is connected to the second input line 30. This causes the first shunting transistor 64, which is chosen to be a pnp type, to conduct, thereby shorting the first input line 28 to the common junction line 26. On the other hand, if the first input line 28 is negative with respect to that of the second input line 30, then current flow is blocked by the first blocking diode 74, and the emitter terminal of the second control transistor 114 is not biased negatively due to the blocking action of the third blocking diode 78. Thus, the second control transistor 114 is not biased on and no current passes through the first shunting transistor 64.

However, when the first input line 28 is negative with respect to that of the second input line 30, the second shunting transistor 66 will conduct provided the collector terminal of the first switching transistor 92 is still positive. As explained above for the first control transistor 108, a third control transistor 126 is also biased on as a result of a positive voltage appearing at the collector terminal of the first switching transistor 92. Thus, when the third control transistor 126 is biased on, a current through an associated dropping resistor 128 is applied to a light emitting diode 130 in a second optical coupler 132. Light radiated from the light emitting diode 130 causes an associated light-responsive transistor 134 to conduct, thereby applying the positive voltage on the second input line 30 through the fourth blocking diode 80 and a dropping resistor 136 to the base of the second shunting transistor 66. Thus, the second shunting transistor 66 is biased on which results in the first input line 28 being shorted through the second blocking diode 76 to the common junction line 26. It should be noted, as previously explained, that the first shunting transistor 64 is chosen as a pnp type so that a negative voltage applied to its base terminal will cause a positive voltage appearing on the first input line 28 to be shorted to the common junction line 26. The second shunting transistor 66 however is chosen to be an npn type so that a positive voltage applied to its base terminal will cause the common junction line 26 to be shorted to the first input line 28 when the first input line 28 voltage is negative with respect to that of the second input line 30. As previously explained, when the collector terminal of the first switching transistor 92 is connected to the return line 101, due to the first switching transistor being turned on by the square wave oscillator 90, the base terminals of the first and third control transistors 108 and 126, respectively, are also connected to the return line 101. This results in the first and third control transistors 108 and 126 being biased off and no current flowing through the light emitting diodes 116 and 130. Without current flowing through the light emitting diodes 116 and 130, neither the first shunting transistor 64 nor the second shunting transistor 66 will conduct, thereby isolating the first input line 28 from the common junction line within the relay 86.

In a similar manner to that of the first and second shunting transistors 64 and 66, control of the third and fourth shunting transistors 68 and 70 is effected, the only difference being that the base terminals of fourth and fifth control transistors 140 and 142, corresponding to the first and third control transistor 108 and 126, respectively, are connected to the collector terminal of the second switching transistor 102. Thus as previously explained, when the collector terminal of the first switching transistor 92 is positive, the collector terminal of the second switching transistor 102 will be connected through is associated emitter terminal to the return line 101, thus biasing the fourth and fifth control transistors 140 and 142 off. This biasing off, as previously explained, prevents the third and fourth shunting transistors 68 and 70 from conducting. However, when the collector terminal of the second switching transistor 102 becomes positive, the fourth and fifth control transistors 140 and 142 will conduct, thereby causing light emitting diodes 144 and 146 to radiate. The third and fourth shunting transistors 68 and 70 are then controlled in a manner identical to that previously explained for the first and second shunting transistors 64 and 66.

A significant feature of the circuitry provided in the exemplary embodiment is the optical couplers which isolate control circuitry for the shunting transistors from a ground associated either with the flasher relay 86 or the train sensor. This isolation is essential in order to prevent excessive current flow due to ground drifts between the AC or DC power source and the flasher relay, the relay and power source sometimes being located significant distances apart. Thus with the relay above-described utilizing optical couplers for such isolation, the grounds of the power sources can drift significantly with respect to a ground associated with the flasher relay or train sensor without adversely effecting either the circuitry of the flasher relay itself or the operation of the switching function.

Referring now to the waveform diagrams of FIG. 4 in conjunction with the circuit diagram of FIG. 3, operation of the flasher relay 86 can be further understood. Waveform A shows AC voltage power appearing on the first input line 28 with respect to that on the second input line 30. Waveform B shows the output of the square wave oscillator 90 when activated by the train sensor, the frequency of the output determining the switching rate between the first and second loads Z1 and Z2. Waveform C shows the voltage present at the collector terminal of the first switching transistor 92, this voltage being out of phase with respect to the output of the square wave oscillator 90. Waveform D shows the voltage at the collector terminal of the second switching transistor 102 which is 180 degrees out of phase with the voltage at the collector terminal of the first switching transistor 92. Waveform E corresponds to the voltage present at the emitter terminal of the first control transistor 108, this voltage being in phase with the voltage at the collector terminal of the first switching transistor 92. Waveform F shows the voltage at the emitter terminal of the fourth control transistor 140, this voltage being 180 degrees out of phase with the voltage at the emitter terminal of the first control transistor 108. Thus, when the first and third control transistors 108 and 126 are biased on by a positive voltage at their base terminals, the fourth and fifth control transistors 140 and 142 are biased off, thereby preventing conduction through either the third or fourth shunting transistors 68 and 70 as previously explained.

Operation of the flasher relay 86 can now be visualized by referring to Waveforms G and H, G being the voltage differential between the first input line 28 and the common junction line 26, and H being the voltage differential between the common junction line 26 and the second input line 30. When the square wave oscillator 90 output is high as shown at 150, the voltage at the emitter terminals of the first control transistor 108 and the third control transistor 126 is low as shown in Waveform E at 152, thereby biasing them off. Thus, no current flows through the light emitting diodes 116 and 130 and, regardless of the polarity of the voltage appearing on the first input line 28 with respect to that of the second input line 30, no current flows through the first and second shunting transistors 64 and 66. However, both light emitting diodes 144 and 146 are radiating due to a positive voltage at the emitter terminals of the fourth and fifth control transistors 140 and 142 as previously explained. Thus, during those times when the voltage of the first input line 28 with respect to that of the second input line 30 is positive, the third shunting transistor 68 conducts, thereby shorting the second input line 30 to the common junction line 26 as indicated in Waveform H at 160. In a similar manner, when the voltage differential between the first input line 28 and the second input line 30 is negative, the fourth shunting transistor 70 conducts thereby resulting in shorting the second input line 30 to the common junction line 26 as shown at 162 in Waveform H. Since both the first and second shunting transistors 64 and 66 are biased off, the waveform appearing between the first input line 28 and the common junction line 26 is as shown in Waveform G at 164. When Waveform E returns to a high or positive potential shown at 165, Waveform F returns to a ground potential or low as shown at 166, thereby biasing the third and fourth shunting transistors 68 and 70 off. As as a result of current flowing through the two light emitting diodes 116 and 130, the first shunting transistor 64 is biased on as previously explained, thereby shorting the first input line 28 and the common junction line 26 as shown at 168 in Waveform G. When the voltage on the first input line 28 is negative with respect to that on the second input line 30, the second shunting transistor 66 conducts, thereby shorting the first input line 28 to the common junction line 26 as shown at 170 in Waveform G. Thus, the waveform shown at 174 in Waveform H is applied across the second load Z2.

It can be readily appreciated that for a DC voltage applied across the first and second input lines 28 and 30, the appropriate shunting transistor will conduct depending on the polarity of the voltage. However, for a given polarity only one shunting transistor across the first load Z1 will conduct, and only one transistor across the second load Z2 will conduct.

Thus, from the above description, it can be readily appreciated that a solid state flasher relay has been disclosed which directly switches either AC or DC voltages across two serially-connected loads in accordance with a control signal defining a switching rate. It should also be appreciated that a solid state flashing relay provided by the invention operates regardless of the polarity of the voltage source appearing across the first and second loads, this voltage being applied at points external to the relay itself.

What is claimed is:

1. A flasher relay of the type wherein an AC or DC input voltage provided across first and second loads interconnected in series at a common junction can be selectively applied across said first load or said second load, said input voltage is applied to said first and second loads via first and second input, lines, said relay comprising:

first solid state shunting means for shunting said first load so that said input voltage is applied across said second load;

second solid state shunting means for shunting said second load so that said input voltage is applied across said first load;

means for selectively controlling said first and second means so as to alternately shunt said first and second loads;

said first solid state shunting means comprising, a first shunting transistor connected between said first input line and said common junction, said first transistor being chosen to conduct when a voltage potential across said first and second loads is of one polarity and said first transistor is biased on and a second shunting transistor connected between said first input line and said common junction, said second transistor being chosen to conduct when a voltage potential across said first and second loads is of the other polarity and said second transistor is biased on;

said means for selectively controlling comprises means for biasing said first and second transistors so that said first input line is continually shunted to said common junction by either said first or second transistor regardless of the polarity of the input voltage across said first and second loads; and said second solid state shunting means comprises, a third shunting transistor connected between said second input line and said common junction, said third transistor being chosen to conduct when a voltage potential across said first and second loads is of one polarity and said third transistor is biased on;

a fourth shunting transistor connected between said second input line and said common junction, said fourth transistor being chosen to conduct when a voltage potential across said first and second loads is of the other polarity and said fourth transistor is biased on; and said means for selectively controlling further comprises means for preventing said third or fourth transistor from conducting when either said first or second transistor is conducting, means for biasing said third and fourth transistors so that said second input line is continuously shunted to said common junction by either said third or fourth transistor regardless of the polarity of the input voltage across said first and second loads, and means for preventing said first or second transistor from conducting when either said third or fourth transistor is conducting.

2. The relay of claim 1 wherein said first and fourth shunting transistors are pnp transistors and said second and third shunting transistors are npn transistors, said first, second, third and fourth transistors having their collector terminals connected to said common junction.

3. The relay of claim 1 wherein said common junction is electrically isolated from ground.

4. The relay of claim 3 wherein said means for selectively controlling further comprises means for isolating base terminals of said first, second, third and fourth transistors from ground.

5. The relay of claim 4 wherein said means for selectively controlling further comprises:

a square wave oscillator responsive to an external control signal; and said means for isolating comprises first, second third and fourth optical coupling control means responsive to said square wave oscillator for biasing of said first, second, third and fourth transistors, respectively.

6. The relay of claim 5 wherein each of said optical coupling control means comprises a light emitting diode and an associated light-responsive transistor which can conduct only when illuminated by said light emitting diode.

7. The relay of claim 6 wherein said square wave oscillator comprises switching means for sequentially causing said light emitting diodes in said first and second optical coupling control means to radiate, and said light emitting diodes in said third and fourth optical coupling control means to radiate.

8. The relay of claim 7 further comprising means for generating a DC current responsive to said switching means for activating said light emitting diodes.

9. The relay of claim 8 wherein said means for generating comprises a full wave rectifier connected across said first and second loads.

10. The relay of claim 7 wherein said means for selectively controlling further comprises means for causing said first shunting transistor to conduct when said first input line voltage is positive with respect to said second input line voltage and said first light emitting diode is radiating, and means for causing said second shunting transistor to conduct when said first input voltage line is negative with respect to said second input line voltage and said second light emitting diode is radiating.

11. The relay of claim 10 wherein first said optical coupling control means light-responsive transistor is an npn transistor having base, emitter, and collector terminals and said means for causing said first shunting transistor to conduct comprises:

a second control npn transistor having base emitter and collector terminals;

means for interconnecting said first optical coupling control means light-responsive transistor base terminal, emitter terminal and said second control transistor base terminal;

means for interconnecting said first optical coupling control means light-responsive transistor collector terminal, said second control transistor collector terminal, and said first shunting transistor base terminal; and means for interconnecting said second control transistor emitter terminal and said second input line.

12. The relay of claim 11 wherein said means for interconnecting said control transistor emitter terminal to said second input line comprises:

a first biasing resistor having one end connected to said second control transistor emitter terminal; and a first blocking diode having its anode connected to said biasing resistor other end and its cathode connected to said second input line.

13. The relay of claim 12 wherein said second optical coupling control means light-responsive transistor is an npn transistor having base, emitter and collector terminals and said means for causing said second shunting transistor to conduct comprises:

a third control npn transistor having base, emitter and collector terminals;

means for interconnecting said second optical coupling control means light-responsive transistor base and emitter terminals, and said third control transistor base terminal;

means for interconnecting said second optical coupling control means light-responsive transistor collector terminal and said third control transistor collector terminal;

means for interconnecting said third control transistor emitter terminal and said second shunting transistor base terminal; and means for interconnecting said third control transistor collector terminal and said second input line.

14. The relay of claim 11 wherein said means for interconnecting said third control transistor collector terminal and said second input line comprises:

a second biasing resistor having one end connected to said third control transistor collector terminal; and a second blocking diode having its cathode connected to said biasing resistor other end and its anode connected to said second input line.

15. A flasher relay for selectively shorting a first input line and a second input line to a common junction line, said first input line and common junction line having a first load connected therebetween, and said second input line and common junction line having a second load connected therebetween, said relay comprising:

a first shunting transistor connected between said first input line and said common junction line;

a second shunting transistor connected between said first input line and said common junction line;

a third shunting transistor connected between said second input line and said common junction line;

a fourth shunting transistor connected between said second load and said common junction line;

first means for controlling said first and second shunting transistors so that said first shunting transistor will conduct when a voltage on said first input line is positive with respect to that on said second input line, and said second shunting transistor will conduct when a voltage on said first input line is negative with respect to that on said second input line; and second means for controlling said third and fourth transistors so that neither will conduct if either said first or second shunting transistor is conducting.

16. The flasher relay of claim 15 wherein said second means for controlling comprises means for causing said third shunting transistor to conduct when a voltage on said second input line is negative with respect to that on said first input line and neither said first or second shunting transistor is conducting and means for causing said fourth shunting transistor to conduct when a voltage on said second input line is positive with respect to that on said first input line and neither said first or second shunting transistor is conducting.

17. The flasher relay of claim 16 further comprising:

flashing means responsive to an externally generated activation signal for generating a repetitively occuring signal having first and second states of predetermined durations; and means for interconnecting said flashing signal to said first and second means for controlling so that said first state will cause either said first or second shunting transistors to conduct and prevent said third and fourth shunting transistors from conducting, and said second state will cause either said third or fourth shunting transistors to conduct and prevent said first or second shunting transistors from conducting.

18. The flasher relay of claim 17 wherein said first and second means for controlling comprises means for isolating said common junction line from ground within said flasher relay.

19. The flasher relay of claim 18 wherein said means for isolating comprises optical control means associated with each of said first, second, third and fourth shunting transistors, each of said optical control means comprising a light emitting diode responsive to said flashing means and an associated light-responsive transistor operatively connected to one of said shunting transistors and having a conductive state controllable by said light emitting diode.

20. A flasher relay of the type which can selectively switch an AC input voltage differential across first or second loads interconnected at a common junction, said relay having as inputs a first line connected to said first load, a second line connected to said second load, and a third line connected to said common junction, said AC voltage being provided across said first and second lines at points external to said relay; said relay comprising:

state control means for generating a control signal of first and second states having predetermined time durations;

first, second, third and fourth solid state means means for connecting said first and second solid state means across said first load and for connecting said third and fourth solid state means across said second load; and means for alternately activating said first and second solid state means to conduct while said third and fourth solid state means are deactivated not to conduct when the voltage in between said first and second input lines is positive and negative respectively, and for alternately activating said third and fourth solid state means to conduct while said first and second solid state means are deactivated not to conduct when the voltage between said first and second input lines is positive and negative respectively.

21. A method of selectively applying an AC input voltage differential across first or second loads interconnected to a common junction line, said input voltage differential being applied across first and second loads on first and second input lines, respectively, said method comprising the steps of:

generating a flashing signal having first and second states having predetermined time durations;

shunting, in response to said flashing signal first state, said first input line to said common junction through a first shunting transistor when a voltage on said first input line is positive with respect to a voltage on said second input line;

shunting, in response to said flashing signal first state, said first input line to said common junction line through a second shunting transistor when a voltage on said first input line is negative with respect to a voltage on said second input line;

shunting, in response to said flashing signal second state, said second input line to said common junction line through a third shunting transistor when a voltage on said second input line is negative with respect to a voltage on said first input line; and shunting, in response to said flashing signal second state, said second input line to said common junction line through a fourth shunting transistor when a voltage on said second input line is positive with respect to a voltage on said first input line.

* * * * *